US008149202B2

(12) United States Patent
Jiang et al.

(10) Patent No.: US 8,149,202 B2
(45) Date of Patent: Apr. 3, 2012

(54) FLAT DISPLAY AND METHOD FOR MODULATING A CLOCK SIGNAL FOR DRIVING THE SAME

(75) Inventors: Jian-Xun Jiang, Sanxia Town (TW); Chih-Hsun Weng, Yonghe (TW)

(73) Assignee: Chimei Innolux Corporation, Chu-Nan (TW)

( * ) Notice: Subject to any disclaimer, the term of this patent is extended or adjusted under 35 U.S.C. 154(b) by 963 days.

(21) Appl. No.: 12/006,621

(22) Filed: Jan. 4, 2008

(65) Prior Publication Data

US 2009/0040160 A1 Feb. 12, 2009

Related U.S. Application Data

(60) Provisional application No. 60/964,284, filed on Aug. 9, 2007.

(51) Int. Cl.
*G09G 3/36* (2006.01)

(52) U.S. Cl. ..... 345/94; 345/60; 345/87; 345/208; 345/213

(58) Field of Classification Search ..... 345/60, 345/87–100, 208, 213
See application file for complete search history.

(56) References Cited

U.S. PATENT DOCUMENTS

| | | | | |
|---|---|---|---|---|
| 6,720,943 | B1 * | 4/2004 | Kim et al. | 345/87 |
| 7,193,596 | B2 | 3/2007 | Shibata et al. | |
| 2001/0026252 | A1 * | 10/2001 | Shibata et al. | 345/60 |
| 2006/0164366 | A1 | 7/2006 | Yu et al. | |

FOREIGN PATENT DOCUMENTS

| | | |
|---|---|---|
| CN | 1811888 | 8/2006 |

* cited by examiner

*Primary Examiner* — Alexander Eisen
*Assistant Examiner* — Viet Pham
(74) *Attorney, Agent, or Firm* — Liu & Liu

(57) ABSTRACT

A flat display and a method for modulating a clock signal for driving a flat display are provided. The flat display includes a clock generator and a clock modulator. The clock generator provides a clock signal that includes at least a first cycle waveform and a second cycle waveform following said first cycle waveform. The first cycle waveform is modulated by the clock modulator as a first modulated cycle waveform divided by a first positive modulated cycle waveform and a first negative modulated cycle waveform, and the second cycle waveform is modulated as a second modulated cycle waveform divided by a second positive modulated cycle waveform and a second negative modulated cycle waveform. The first positive modulated cycle waveform and the first negative modulated cycle waveform have a first duration difference, and the second positive modulated cycle waveform and the second negative modulated cycle waveform have a second duration difference different from the first duration difference.

20 Claims, 6 Drawing Sheets

FLAT DISPLAY AND METHOD FOR MODULATING A CLOCK SIGNAL FOR DRIVING THE SAME

CROSS-REFERENCE TO RELATED APPLICATIONS

This application claims the right of priority based on U.S. Provisional Patent Application No. 60/964,284 entitled "METHOD TO REDUCE ACOUSTIC NOISE," filed on Aug. 9, 2007, which is incorporated herein by reference and assigned to the assignee herein.

FIELD OF INVENTION

The present invention relates to a flat display and a method for modulating a clock signal for driving a display, and more particularly to modulate the clock signal in order to reduce acoustic noise emitted from the display.

BACKGROUND OF THE INVENTION

In flat displays like plasma display panels (PDPS) and liquid crystal displays (LCDs), the display panel is driven by a clock signal generated in accordance with a fixed-frequency, which may result in noise problem if the frequency is audible. One solution according to the prior art may simply shift the frequency of the clock signal beyond or below the audible range.

Another solution is to modulate the frequency of the clock signal to spread its spectrum, as shown in FIG. 1. To reduce acoustic noise, the spectrum of the clock signal is spread to decrease the intensity of noise peak, as illustrated by the spectrum 104, compared with the original spectrum 102. For example, the prior art achieves it by continuously varying the frequency of the clock signal, as shown in FIG. 2, so as to spread out noise that the display panel emits.

However, current approaches to reduce noise involve problems in terms of stable operation of the display and the cost of the display, higher power consumption, and drastic measures for solution are needed. Therefore, it is desired to have a novel flat display and a method for modulating a clock signal for driving the display.

SUMMARY OF THE INVENTION

One aspect of the present invention is to provide to a flat display and a method for modulating a clock signal for driving a flat display, particularly in order to modulate the clock signal in order to reduce acoustic noise emitted from the display, without degrading the stable operation.

Another aspect of the present invention is to provide to a flat display and a method for modulating a clock signal for driving a flat display, particularly in order to modulate the frequency of the clock signal to spread its spectrum, without increasing the power consumption.

In one embodiment, disclosed is a flat display including a clock generator and a clock modulator. The clock generator provides a clock signal that includes at least a first cycle waveform and a second cycle waveform following said first cycle waveform. The first cycle waveform is modulated by the clock modulator as a first modulated cycle waveform divided by a first positive modulated cycle waveform and a first negative modulated cycle waveform, and the second cycle waveform is modulated as a second modulated cycle waveform divided by a second positive modulated cycle waveform and a second negative modulated cycle waveform.

The first positive modulated cycle waveform and the first negative modulated cycle waveform have a first duration difference, and the second positive modulated cycle waveform and the second negative modulated cycle waveform have a second duration difference different from the first duration difference. In another embodiment, disclosed is method for modulating a clock signal for driving the flat display mentioned above.

The foregoing and other features of the invention will be apparent from the following more particular description of embodiment of the invention.

BRIEF DESCRIPTION OF THE DRAWINGS

The invention will now be further described by way of example only with reference to the accompany drawings in which.

DETAILED DESCRIPTION OF THE PREFERRED EMBODIMENTS

FIG. 3 is a block diagram of the flat display 300 according to an embodiment of the present invention. In this embodiment, the flat display 300 is a color image display integrated into an information device, like a TV, a mobile phone, a digital camera, a personal digital assistant (PDA), a notebook computer, a desktop computer, a television, a global positioning system (GPS), a car media player, an avionics display, a digital photo frame, a portable video player, etc.

Figure 1:
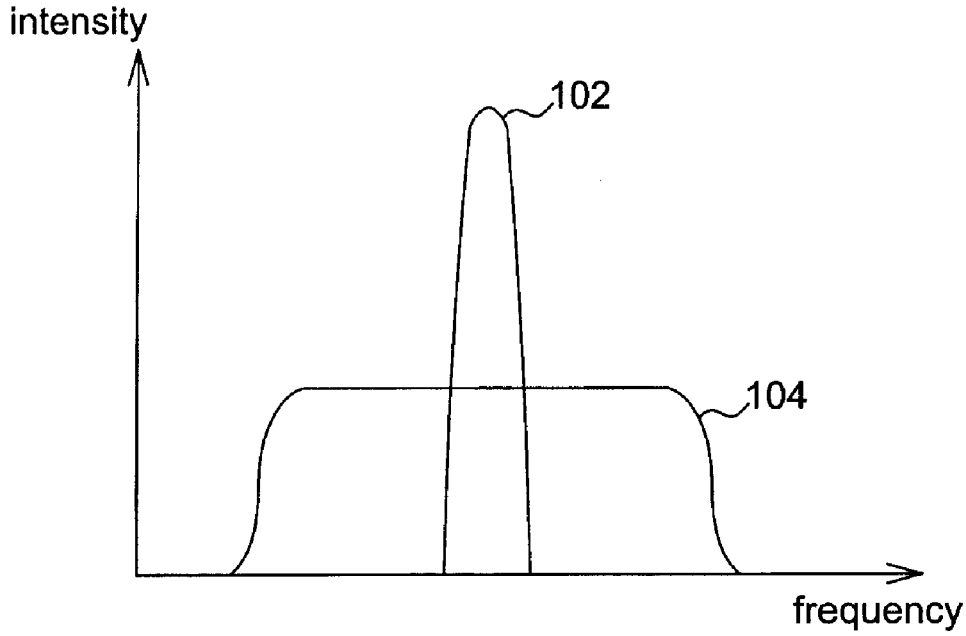
FIG. 1 (Prior Art)
FIG. 1 is a diagram showing the intensity versus frequency relationship of the spread-type clock signal.
Figure 2:
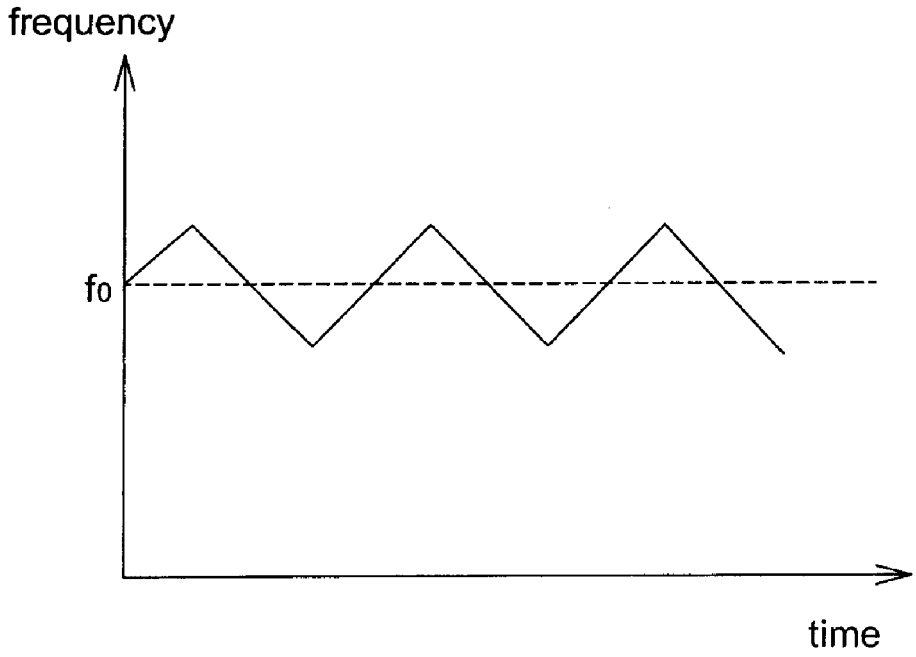
FIG. 2 (Prior Art)
FIG. 2 shows a clock signal whose frequency varies continuously according to prior art.
Figure 3A:
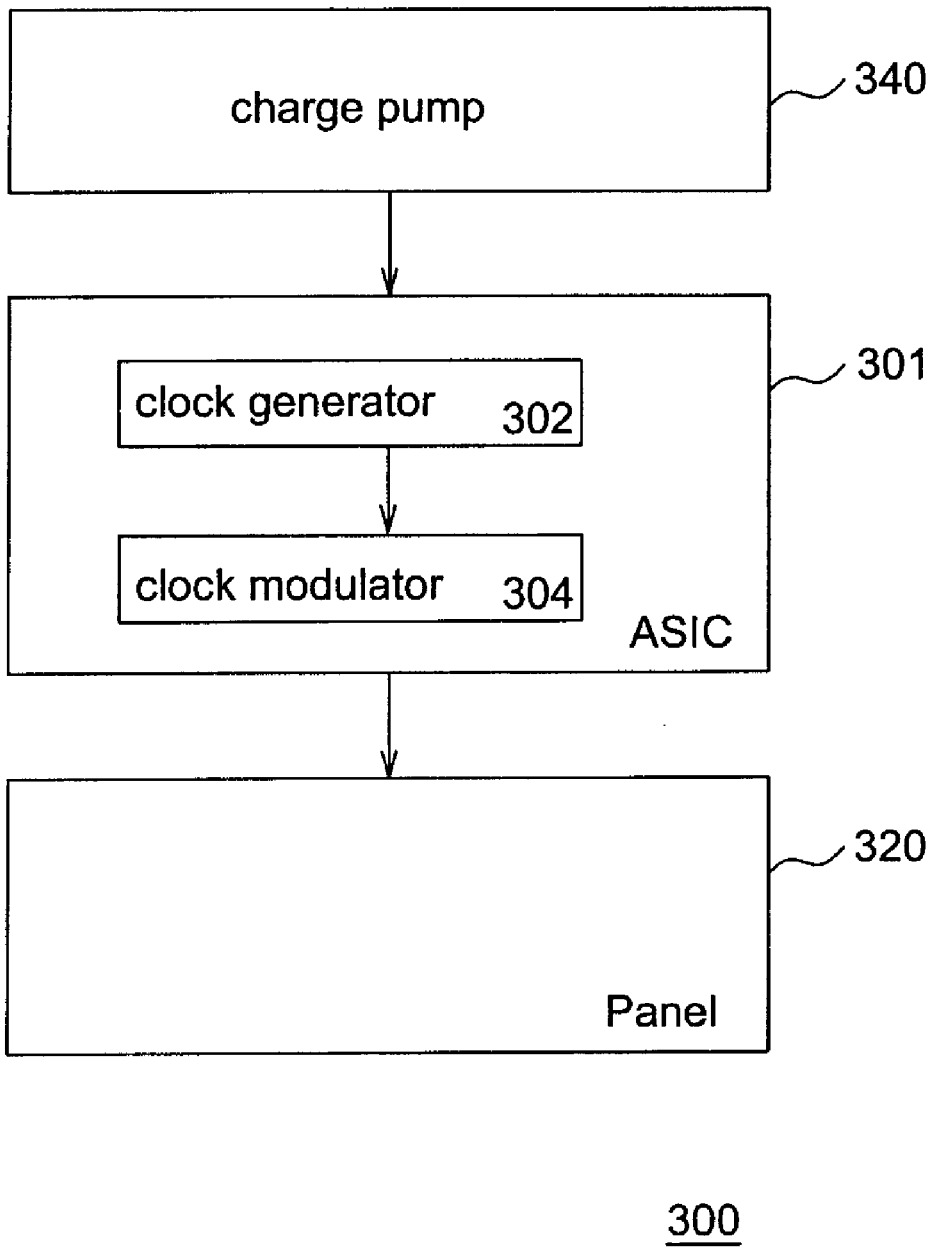
FIG. 3*a* illustrates a flat display according to an embodiment of the present invention

As shown in FIG. 3*a*, the flat display 300 has an ASIC 301, a panel 320, and a charge pump 340. The ASIC 301 further has a clock generator 302 and a clock modulator 304 embedded therein to receive the voltage signals provided by the charge pump 340 and then send it to the panel 320 providing a common voltage source for the flat display 300. The clock generator 302 provides a clock signal, and the clock modulator 304 is provided to modulate the clock signal received from the clock generator 302. In this embodiment, the clock signal may be generated according to a fixed frequency audible to the user, e.g., between 20 Hz and 20 kHz and may cause noise if not further modulated. The clock generator 302 and the clock modulator 304 may be implemented as separated circuits, or integrated as a single circuit.

Figure 3B:
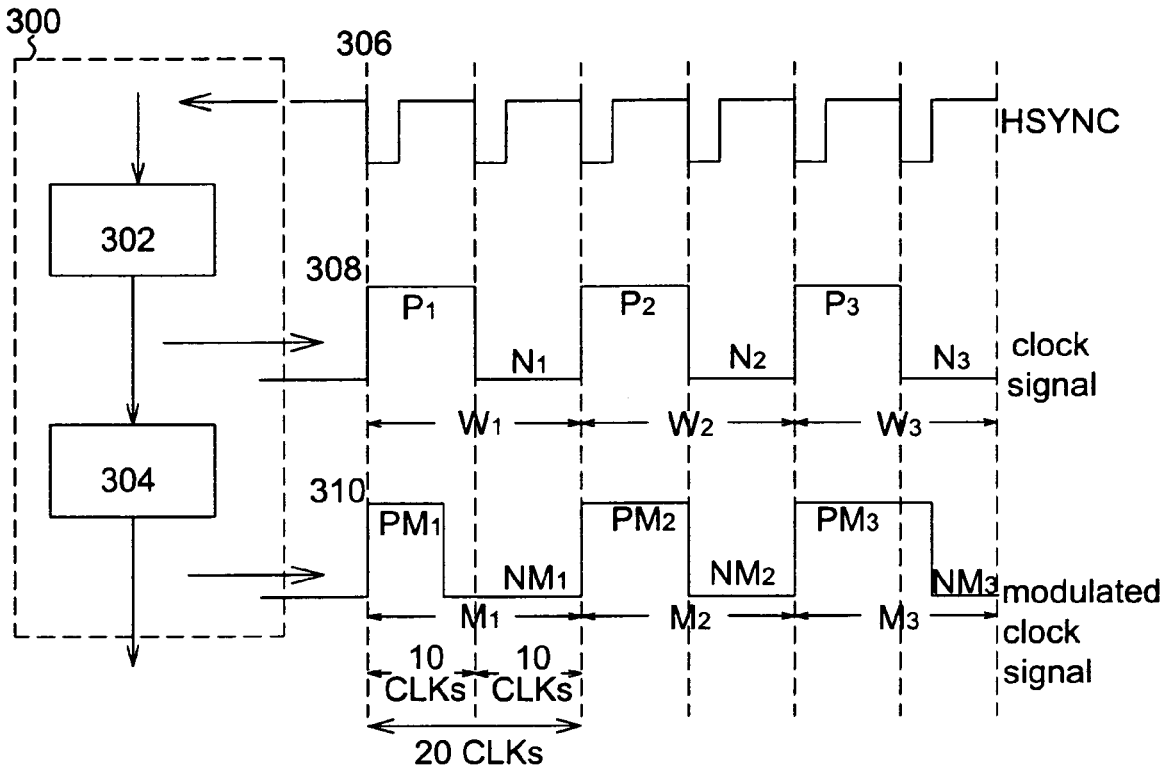
FIG. 3*b* illustrates the clock signal and the modulated clock signal according to an embodiment of the present invention.

The clock signal 308, as a square-wave signal as shown in FIG. 3*b*, includes at least a first cycle waveform W1, a second cycle waveform W2 following the first cycle waveform W1, and a third cycle waveform W3 following the second cycle waveform W2. The display 300 may further include a counter (not shown) to count the duration (or period) of these cycle waveforms. Durations of these three consecutive cycle waveforms can be respectively equal to 20 clocks (CLKs), for example. A trigger signal 306, such as the HSYNC signal or VSYNC signal, is provided to the clock generator 302 in order to trigger the rising and falling of the cycle waveforms.

Generally, for the clock signal 308, the first cycle waveform W1 is divided equally by a first positive cycle waveform P1 and a first negative cycle waveform N1, the second cycle waveform is divided equally by a second positive cycle waveform P2 and a second negative cycle waveform N2, and the third cycle waveform is divided equally by a third positive cycle waveform P3 and a third negative cycle waveform N3. Accordingly, positive cycle waveforms P1, P2, P3, and negative cycle waveforms N1, N2, N3, respectively can be a duration of 10 CLKs.

As shown in FIG. 3*b*, the clock signal 308 is modulated by the clock modulator 304 as the modulated clock signal 310, wherein the first cycle waveform W1 is modulated by the clock modulator 304 as a first modulated cycle waveform M1 divided by a first positive modulated cycle waveform PM1 and a first negative modulated cycle waveform NM1, the second cycle waveform is modulated as a second modulated cycle waveform divided by a second positive modulated cycle waveform PM2 and a second negative modulated cycle waveform NM2, and the third cycle waveform is modulated as a third modulated cycle waveform divided by a third positive modulated cycle waveform PM3 and a third negative modulated cycle waveform NM3. The durations of the first modulated cycle waveform, the second modulated cycle waveform, and the third modulated cycle waveform can be respectively equal to 20 CLKs, as same as the first cycle waveform, the second cycle waveform, and the third cycle waveform. However, as shown in FIG. 3*b*, the first modulated cycle waveform may not be equally divided by the first positive modulated cycle waveform PM1 and the first negative modulated cycle waveform NM1, and the second modulated cycle waveform and the third modulated cycle waveform may not, either. By such an arrangement, the clock signal 308 is modulated in order to reduce acoustic noise emitted from the display, without degrading the stable operation.

Figure 3C:
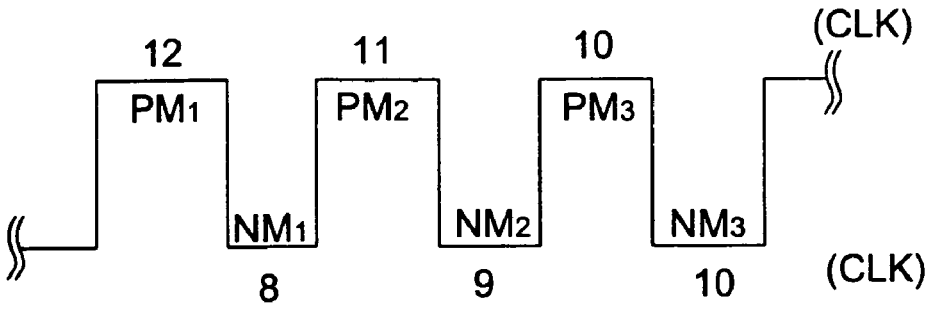
FIG. 3*c* illustrates the modulated clock signal according to an embodiment of the present invention.

In an alternative embodiment shown in FIG. 3*c*, the cycle waveform PM1 can have 12 CLKs and the NM1 can have 8 CLKs, so a first duration difference is 4 CLKs; the cycle waveform PM2 has 11 CLKs and the NM2 has 9 CLKs, so a second duration difference is 2 CLKs, different from the first duration difference (4 CLKs); the cycle waveform PM3 has 10 CLKs and the NM3 has 10 CLKs too, so a third duration difference is 0 CLK, different from the second duration difference (2 CLKs). Meanwhile the second duration difference (2 CLKs) is the median of the first duration difference (4 CLKs) and the third duration difference (0 CLK). In other words, these three duration differences decrease by the same increment.

Figure 3D:
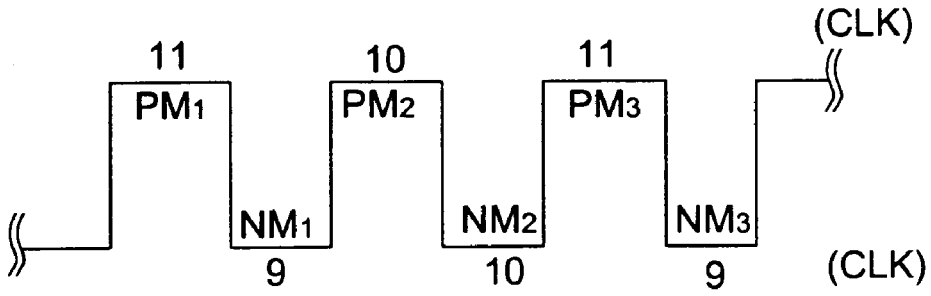
FIG. 3*d* illustrates the modulated clock signal according to an embodiment of the present invention.

In another embodiment shown in FIG. 3*d*, the cycle waveform PM1 has 11 CLKs and the NM1 has 9 CLKs, so a first duration difference is 2 CLKs; the cycle waveform PM2 has 10 CLKs and the NM2 has 10 CLKs too, so a second duration difference is 0 CLK, different from the first duration difference (2 CLKs); the cycle waveform PM3 has 11 CLKs and the NM3 has 9 CLKs, so a third duration difference is 2 CLK, different from the second duration difference, but as same as the first duration difference (2 CLKs).

Figure 3E:
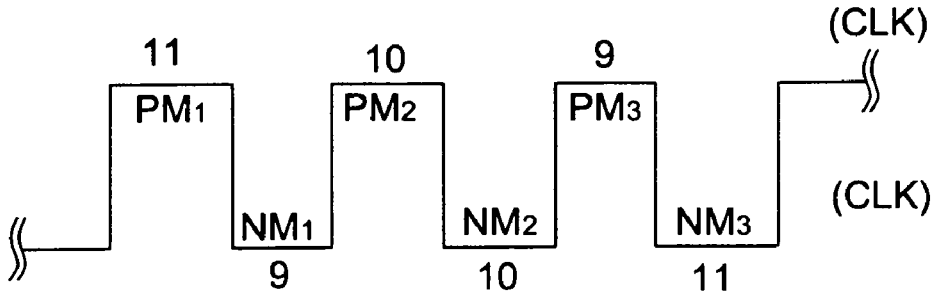
FIG. 3*e* illustrates the modulated clock signal according to an embodiment of the present invention.

In yet another embodiment shown in FIG. 3*e*, the cycle waveform PM1 has 11 CLKs and the NM1 has 9 CLKs, so a first duration difference is 2 CLKs; the cycle waveform PM2 has 10 CLKs and the NM2 has 10 CLKs too, so a second duration difference is 0 CLK, different from the first duration difference (2 CLKs); the cycle waveform PM3 has 9 CLKs and the NM3 has 11 CLKs, so a third duration difference is −2 CLK, different from the second duration difference (0 CLK). However, the absolute value of said third duration difference is equal to the absolute value of said first duration difference.

Figure 3F:
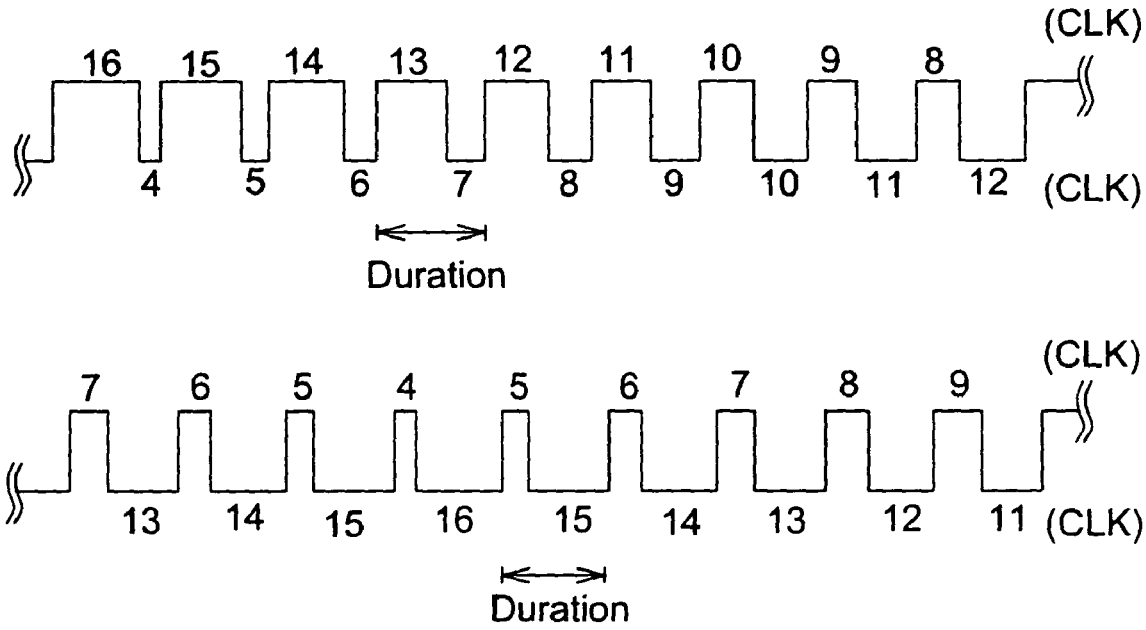
FIG. 3*f* illustrates the clock signal and the modulated clock signal according to an embodiment of the present invention.

In the embodiment shown in FIG. 3*f*, the duration of each modulated cycle waveform is 20 CLKs, as same as those before modulated. Particularly, the duration ratio of a positive modulated cycle waveform (or a negative modulated cycle waveform) to the whole modulated cycle waveform is periodically varied in a range of 20%-80%, which corresponds to a positive modulated cycle waveform of 4 CLKs-16 CLKs. In addition, the variation in this embodiment is continuous, such as one more or one less CLK for each subsequent positive or negative cycle waveform. As shown, the durations of the positive cycle waveform decrease from 16 CLKs to 4 CLKs and then start to increase, and the negative cycle waveforms, in response, increase from 4 CLKs to 16 CLKs and then decrease. However, the duration ratio of a positive modulated cycle waveform (or a negative modulated cycle waveform) to the modulated cycle waveform may be varied in any other way that helps spreading the spectrum of the modulated clock signal.

Figure 3G:
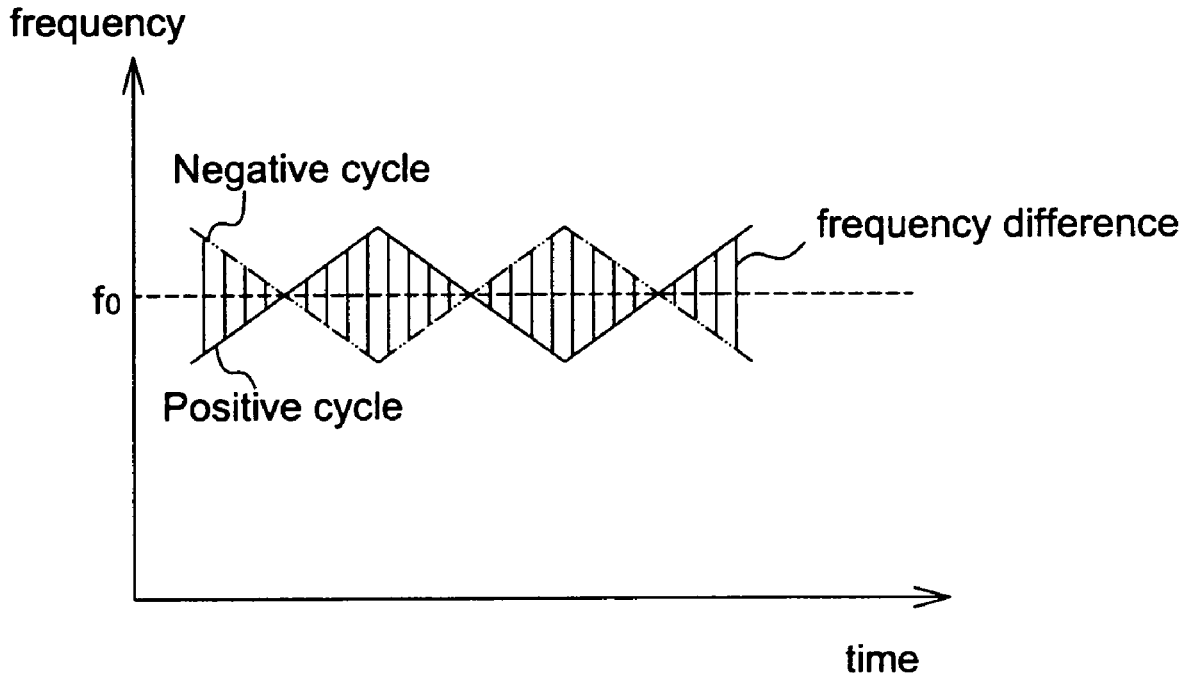
FIG. 3*g* shows the varied frequency difference between the positive cycle and the negative cycle according to an embodiment shown in FIG. 3*f*.

By modulating the durations of the positive cycle and the negative cycle, the clock modulator 304, in the frequency domain, can be deemed to vary frequencies of the positive cycle waveforms and the negative cycle waveforms, respectively. The clock modulator 304 spread the spectrum by achieving a varying frequency difference between the positive cycle waveforms and the negative cycle waveforms, as shown in FIG. 3*g*, instead of directly varying the frequency of the whole clock signal, to maintain the stable operation of the display 300. The frequency difference between positive cycle waveforms and the negative cycle waveforms can change continuously and periodically. By such an arrangement, the frequency of the clock signal 308 is modulated to spread its spectrum, without increasing the power consumption.

Based on the flat display 300, the present invention further discloses a method for modulating a clock signal for driving a flat display. At first, the clock signal is provided, which in includes at least a first cycle waveform, a second cycle waveform following the first cycle waveform, and a third cycle waveform following the second cycle waveform.

Then, the first cycle waveform is modulated as a first modulated cycle waveform divided by a first positive modulated cycle waveform and a first negative modulated cycle waveform. And the second cycle waveform is modulated as a second modulated cycle waveform divided by a second positive modulated cycle waveform and a second negative modulated cycle waveform; also, the third cycle waveform is modulated as a third modulated cycle waveform divided by a third positive modulated cycle waveform and a third negative modulated cycle waveform.

The durations of the first modulated cycle waveform, the second modulated cycle waveform, and the third modulated cycle waveform can respectively equal to 20 CLKs, as same as the first cycle waveform, the second cycle waveform, and the third cycle waveform. However, the first modulated cycle waveform may not be equally divided by the first positive modulated cycle waveform PM1 and the first negative modulated cycle waveform NM1, and the second modulated cycle waveform and the third modulated cycle waveform may not, either. In one embodiment, the first, second, and third duration difference increase or decrease by a same increments, but in another embodiment, the third duration difference is equal to the first duration difference. Or in yet another embodiment, the absolute value of the third duration difference is equal to the absolute value of the first duration difference.

While this invention has been described with reference to the illustrative embodiments, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

We claim:

1. A flat display, comprising:

a clock generator providing a clock signal, said clock signal comprising at least a first cycle waveform and a second cycle waveform immediately following said first cycle waveform; and a clock modulator modulating said clock signal, wherein said first cycle waveform is modulated as a first modulated cycle waveform made up of a first positive modulated cycle waveform and a first negative modulated cycle waveform, and said second cycle waveform is modulated as a second modulated cycle waveform made up of a second positive modulated cycle waveform and a second negative modulated cycle waveform, and durations of said first modulated cycle waveform, said second modulated cycle waveform, said first cycle waveform and said second cycle waveform are equal, wherein said first positive modulated cycle waveform and said first negative modulated cycle waveform within same said first modulated cycle waveform have a first duration difference, and said second positive modulated cycle waveform and said second negative modulated cycle waveform within same said second modulated cycle waveform have a second duration difference different from said first duration difference.

2. The flat display according to claim 1, wherein said clock signal is originally generated according to an audible frequency, and said clock signal is modulated by said clock modulator to generate other frequency that is not audible.

3. The flat display according to claim 1, wherein a first duration ratio of a first positive modulated cycle waveform to said first modulated cycle waveform and a second duration ratio of a second positive modulated cycle waveform to said second modulated cycle waveform are in a range of 20%-80%.

4. The flat display according to claim 1, wherein said clock signal further comprises a third cycle waveform following said second cycle waveform;

wherein said third cycle waveform is modulated by said clock modulator to as a third modulated cycle waveform divided by a third positive modulated cycle waveform and a third negative modulated cycle waveform, and said third positive modulated cycle waveform and said third negative modulated cycle waveform have a third duration difference different from said second duration difference.

5. The flat display according to claim 4, wherein said third duration difference is equal to said first duration difference.

6. The flat display according to claim 4, wherein the absolute value of said third duration difference is equal to the absolute value of said first duration difference.

7. The flat display according to claim 4, wherein said second duration difference is the median of said first duration difference and said third duration difference.

8. The flat display according to claim 4, wherein the durations of said first modulated cycle waveform, said second modulated cycle waveform, and said third modulated cycle waveform are equal.

9. The flat display according to claim 4, wherein a first duration ratio of a first positive modulated cycle waveform to said first modulated cycle waveform, a second duration ratio of a second positive modulated cycle waveform to said second modulated cycle waveform, a third duration ratio of a third positive modulated cycle waveform to said third modulated cycle waveform are in a range of 20%-80%.

10. The flat display according to claim 1, further comprising:

an ASIC, wherein said clock generator and said clock modulator are embedded in said ASIC;

a charge pump; and a panel:

wherein said ASIC receives the voltage signals provided by said charge pump and then send it to said panel for providing a common voltage source.

11. A method for modulating a clock signal for driving a flat display, said flat display having a clock generator and a clock modulator, said method comprising:

providing said clock signal by said clock generator, wherein said clock signal comprises at least a first cycle waveform and a second cycle waveform immediately following said first cycle waveform; and modulating said clock signal by said clock modulator, comprising:

modulating said first cycle waveform as a first modulated cycle waveform made up of a first positive modulated cycle waveform and a first negative modulated cycle waveform; and modulating said second cycle waveform as a second modulated cycle waveform by made up of a second positive modulated cycle waveform and a second negative modulated cycle waveform and said second positive modulated cycle waveform and said second negative modulated cycle waveform, wherein durations of said first modulated cycle waveform, said second modulated cycle waveform, said first cycle waveform and said second cycle waveform are equal, wherein said first positive modulated cycle waveform and said first negative modulated cycle waveform within same said first modulated cycle waveform have a first duration difference, and said second positive modulated cycle waveform and said second negative modulated cycle waveform within same said second modulated cycle waveform have a second duration difference different from said first duration difference.

12. The method according to claim 11, wherein said clock signal is originally generated according to an audible frequency, and said clock signal is modulated by said clock modulator to generate other frequency that is not audible.

13. The method according to claim 11, wherein a first duration ratio of a first positive modulated cycle waveform to said first modulated cycle waveform and a second duration ratio of a second positive modulated cycle waveform to said second modulated cycle waveform are in a range of 20%-80%.

14. The method according to claim 11, wherein said clock signal further comprises a third cycle waveform following said second cycle waveform;

wherein the step of modulating said clock signal comprises modulating said third cycle waveform as a third modulated cycle waveform divided by a third positive modulated cycle waveform and a third negative modulated cycle waveform, and said third positive modulated cycle waveform and said third negative modulated cycle waveform have a third duration difference different from said second duration difference.

15. The method according to claim 14, wherein said third duration difference is equal to said first duration difference.

16. The method according to claim 14, wherein the absolute value of said third duration difference is equal to the absolute value of said first duration difference.

17. The method according to claim 14, wherein said second duration difference is the median of said first duration difference and said third duration difference.

18. The flat display according to claim 1, wherein said clock signal comprises a series of waverform sets, wherein each of said waveform sets comprises said first cycle waveform and said second cycle waveform.

19. The method according to claim 11, wherein said clock signal comprises a series of waverform sets, wherein each of said waveform sets comprises said first cycle waveform and said second cycle waveform.

20. A flat display, comprising:

a clock generator providing a clock signal, said clock signal comprising a series of waveform sets, wherein each of said waveform sets comprises at least a first cycle waveform and a second cycle waveform following successively said first cycle waveform; and a clock modulator modulating said clock signal, wherein each of said first cycle waveforms is modulated as a first modulated cycle waveform made up of a first positive modulated cycle waveform and a first negative modulated cycle waveform, and each of said second cycle waveforms is modulated as a second modulated cycle waveform made up of a second positive modulated cycle waveform and a second negative modulated cycle waveform, and durations of said first modulated cycle waveforms, said second modulated cycle waveforms, said first cycle waveforms and said second cycle waveforms are equal, wherein said first positive modulated cycle waveform of each of said first modulated cycle waveforms and said first negative modulated cycle waveform of each of corresponding same first modulated cycle waveform have a first duration difference, and said second positive modulated cycle waveform of each of said second modulated cycle waveforms and said second negative modulated cycle waveform of each of corresponding same second modulated cycle waveform have a second duration difference different from said first duration difference.

* * * * *